US005194802A

United States Patent [19]

Hill et al.

[11] Patent Number: 5,194,802

[45] Date of Patent: Mar. 16, 1993

[54] TRANSCONDUCTANCE CURRENT REGULATOR USING PRECISELY SAMPLED CHARGES FOR CURRENT CONTROL

[75] Inventors: Kevin E. Hill, Vestal; Gary A. Stefura, Endicott, both of N.Y.

[73] Assignee: General Electric Company, Johnson City, N.Y.

[21] Appl. No.: 782,139

[22] Filed: Oct. 25, 1991

[51] Int. Cl.[5] ..... G05F 1/575

[52] U.S. Cl. ..... 323/280; 323/281; 323/349

[58] Field of Search ..... 323/273, 280, 281, 349; 363/73

[56] References Cited

U.S. PATENT DOCUMENTS 4,933,625 6/1990 Hayakawa ..... 323/280

5,023,541 6/1991 Yosinski ..... 323/280

*Primary Examiner*—Steven L. Stephan

*Assistant Examiner*—Jeffrey Sterrett

*Attorney, Agent, or Firm*—Bernard E. Shay; Stephen A. Young

[57] ABSTRACT

A current regulator providing a highly accurate bidirectional output current, proportional to a control voltage ($V_i$) and suited to monolithic integration is disclosed. The regulator uses a clocked integrator which integrates an error charge, arrived at by taking a precisely ratioed sample charge proportional to a voltage drop ($V_F$), free of its common mode voltage, which is in turn proportional to the load current, and one proportional to the control voltage ($V_i$), and combining them subtractively to form the error charge. The arrangement uses two small charge ratioing capacitors charged respectively to $V_F$ and $V_i$, and a slightly larger integrating capacitor. The clocking is at a 10 KHZ rate. High impedance circuitry is utilized so that highly accurate, integrated capacitors of modest size and high relative accuracy may be used. These establish a regulator transfer function of high accuracy.

10 Claims, 6 Drawing Sheets

VCC
+15V
O1
N3
VCC
MP2
VCC
-15V
VSS
VCC
BIAS
MP1
VI
N2
FIG. 3B S5, S6
$\overline{\phi 2}$
W=3000μ
L=7μ
MP1
VCC
I1
O1
VSS
MN1
W=2000μ
L=10.5μ
$\phi 2$
FIG. 3C S10
$\phi 2A$
MN1
W=12μ
L=3μ
VSS
O1
VSS
MN2
W=12μ
L=3μ
$\phi 2A$
$\overline{\phi 2}$
MN3
VSS
W=12μ
L=3μ
I1

$\overline{\phi 2}$
W=16.5μ
L=7μ
MP1
VCC
S1
IN1
VSS
MN1
W=14μ
L=10.5μ
$\phi 2$
Vi
C1
O1
$\overline{\phi 1}$
W=16.5μ
L=7μ
MP2
VCC
S2
IN2
VSS
MN2
W=14μ
L=10.5μ
$\phi 1$

TRANSCONDUCTANCE CURRENT REGULATOR USING PRECISELY SAMPLED CHARGES FOR CURRENT CONTROL

BACKGROUND OF THE INVENTION

1. Field of the Invention

The invention relates to transconductance current regulators providing an output current accurately proportional to a control voltage, i.e. voltage to current converters, and more particularly to a monolithically integrated circuit suitable for driving a motor for exerting a variable torque responsive to a voltage control.

2. Prior Art

Aircraft engine and flight controls have continued to grow in sophistication as engine requirements and flight requirements have become more complex. The solutions to these control problems have for many years been electronic, even though the ultimate response of the control system is a mechanical movement frequently controlling fluidic flow rates to an engine or using hydraulic actuation in relation to aircraft flight control surfaces. The problem of reliability has been a major concern, and that issue has been dealt with by redundancy.

The demands in an aircraft environment have been reliability, accuracy, performance, compactness, and manufactureability.

The electronic response to these demands are being met by growing use of application specific integrated circuits. The integrated circuits as a class have tended to fall into the digital category for computation, or the analog category for input/output signal processing. A less widely developed class of integrated circuits are those which may be required to possess signal processing functions and yet control significant amounts of power to an electrical motor, or as in the present application to a torque motor for an engine control. Because of the particular needs, the answer has been the creation of application specific integrated circuits (ASICs) capable of handling both kinds of requirements.

The integrated circuit process providing the answer for the present application has been the bipolar bimos (BiMOS) process in which very high impedance metal oxide semiconductor field effect transistor circuitry is combined with low impedance bipolar transistors. The MOS transistors may be used for signal processing where the current and power may be infinitesimal and the bipolar transistors may be used to supply significant amounts of power. The process is readily adapted to processing bidirectional control signals and producing bidirectional output currents to suit the needs of the engine or flight control. In such cases, the control signals may be processed by bidirectional transmission gates using complementary MOSFETs, and the power may be supplied using positive and negative voltage supplies and complementary bipolar transistors.

Granted that the latter approach is being taken, the need is present to perform the control functions with higher reliability, higher accuracy, greater performance, and greater compactness continues. Thus, the integrated circuit that achieved ±2% accuracy and not ±1%, or performed one function and not four; or required many outboarded components rather than a few, or required trimming or tuning rather than none at all becomes the target for further refinement.

SUMMARY OF THE INVENTION

The foregoing objects are achieved, in accordance with the invention, in a novel bidirectional transconductance current regulator in which the control voltage to current relationship is achieved in a clocked degenerative feedback network. The regulator is suitable for monolithic integration with a minimum of external parts, and uses precisely sampled charges to represent the desired current and the load current to a gated integrator in the feedback network.

The current regulator is provided with positive and negative operating potentials for bidirectional operation, a source of control potentials ($V_i$) for establishing a desired load current, and two phase clocking.

Load current is sensed free of common mode voltage by a combination including an external precision resistor, which produces a voltage drop proportional to a load current; a large external capacitor, which stores sufficient charge at the voltage drop to sustain that voltage during subsequent charge sampling and clocked switching means for disconnecting the charged capacitor from the resistor and connecting it, referenced to ground, to a charge sampling circuit.

The regulator further includes a first switched capacitive means for supplying a first sample charge at a precisely fixed ratio to the control voltage ($V_i$), and a second switched capacitive means for supplying a second sample charge at a precisely fixed ratio to the voltage drop ($V_F$).

These charges are then combined subtractively to form an error charge which is supplied to a clocked integrator including an OPAMP. The integrator operates in a clocked fashion to integrate the error charge during one set of clocking intervals, and is reset and corrected for OPAMP offset during alternate clocking intervals. The output of the integrator, delivered via a sample and hold network, is then used to control a second OPAMP, which becomes a driver for the load, providing an accurately regulated bidirectional output current.

The switching associated with the charge ratioing capacitors uses complementary MOSFET transmission gates, and both OPAMPs use high impedance differential MOSFET input stages. In consequence of the high impedance environment and a reasonably fast clocking rate (10 KHZ), the charge ratioing capacitors and the integrator capacitors, which set the accuracy of the regulator, may be quite small and are readily integrated within a minimum area. Complementary bipolar transistors, available in the "BiMOS" process, provide low impedance means for delivering substantial output currents to the load.

The arrangement possesses high accuracy, and is sufficiently compact to allow integration of four such regulators on a single monolithic chip.

BRIEF DESCRIPTION OF THE DRAWINGS

The inventive and distinctive features of the invention are set forth in the claims of the present application. The invention itself, however, together with further objects and advantages thereof may best be understood by reference to the following description and accompanying drawings, in which:

FIG. 1A is a functional diagram of the regulator showing an output configuration in which a load current sensing resistor is connected to the regulator output or "high" and the load, a torque motor, is connected to the $V_{cc}$ and $V_{ss}$ ground returns or "low"; and FIG. 1B shows the current sensing resistor "low" and the torque motor "high";

FIGS. 3A, 3B, 3C, 3D and 3E are circuit diagrams of the individual cells making up the current regulator; FIG. 3A showing a cell constituted of bidirectional MOS-FET transmission gates providing single pole double throw switch action; FIG. 3B showing a similar cell providing bidirectional single pole single throw switch action; FIG. 3C showing a similar cell having a unique single pole single throw action, modified to provide compensation for charge injection by the switch; FIG. 3D showing a cell constituted of MOS-FET and bipolar transistors providing a first operational amplifier for high impedance signal summing and integration functions; and FIG. 3E showing a cell providing a similar operational amplifier having a high input impedance and a low output impedance for delivering significant amounts of power to a torque motor.

PREFERRED EMBODIMENT

Figure 1A:
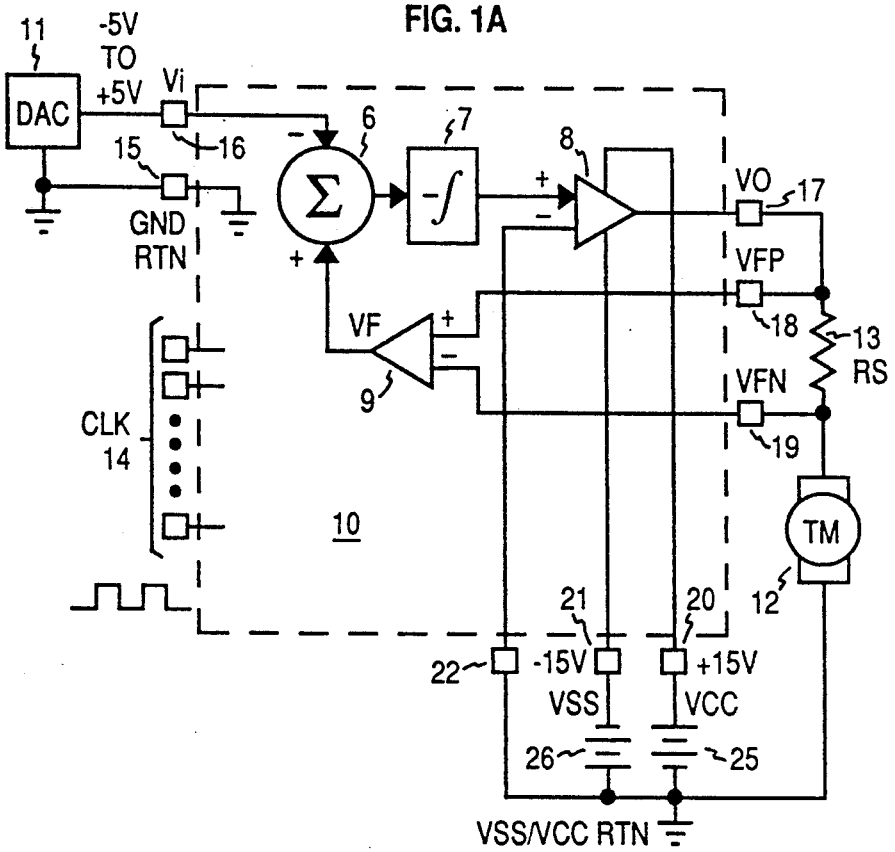
FIGS. 1A and 1B are simplified diagrams of a novel bidirectional transconductance current regulator using a precision sampled feedback network.

Referring now to FIG. 1A, a simplified functional diagram of a novel, bidirectional transconductance current regulator is shown. The desired current settings are established by a digital to analogue converter (DAC) 11 providing a precise analog output voltage ($V_i$) for current control, whose magnitude lies within a range of ±5 volts. The regulator is used to drive a bidirectional torque motor requiring power at the level of up to ±10 volts at precise (±0.25%) currents set by the control voltage of up to 100 milliamperes.

Figure 5:
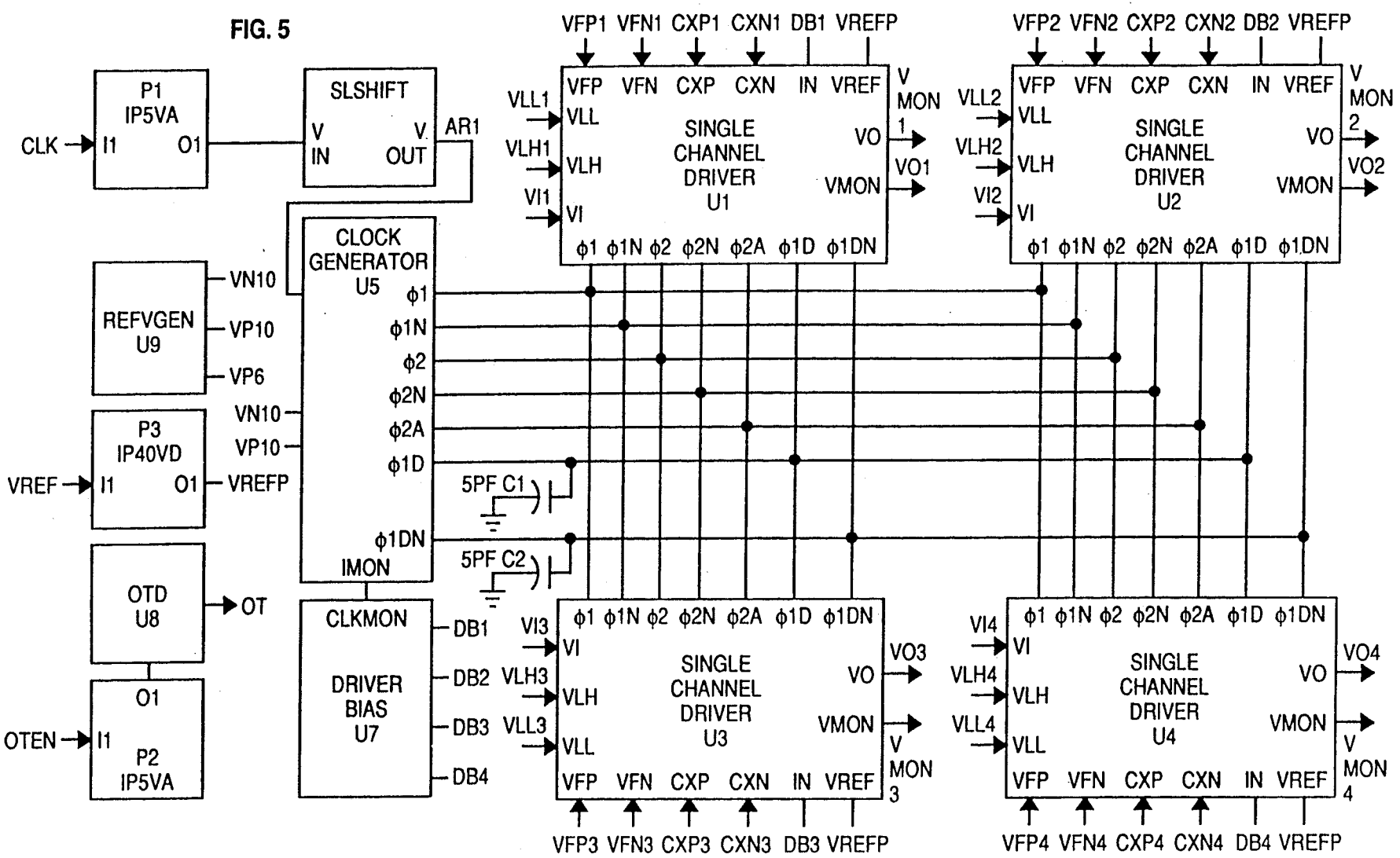
FIG. 5 is a block diagram of an integrated circuit chip in which four current regulators together with the necessary utilities are combined in a single chip.

The bidirectional current regulator 10 is constituted of a plurality of cells contained in an integrated circuit chip whose block diagram is shown in FIG. 5. The external connections to the chip relevant to the current regulator are shown as pads 14 to 22. The analog control voltage ($V_i$), derived from the DAC 11, is coupled to pad 16 and referenced to pad 15 providing a signal ground return. Digital commands (not shown) are supplied to the DAC at a precision suitable for maintaining a system accuracy of ±0.25 percent. The system accuracy requires that the signal ground returns be kept separate from the power ground return 22 for the +15 volt $V_{cc}$ and −15 volt $V_{ss}$ external bias supplies which provide electrical power to the external load. The positive and negative bias supplies are connected between the pads 20, 21 respectively and pad 22 providing the power ground return. The voltage output $V_o$ of the driver appears at pad 17 and is also referenced to the power ground return pad 22.

Figure 1B:
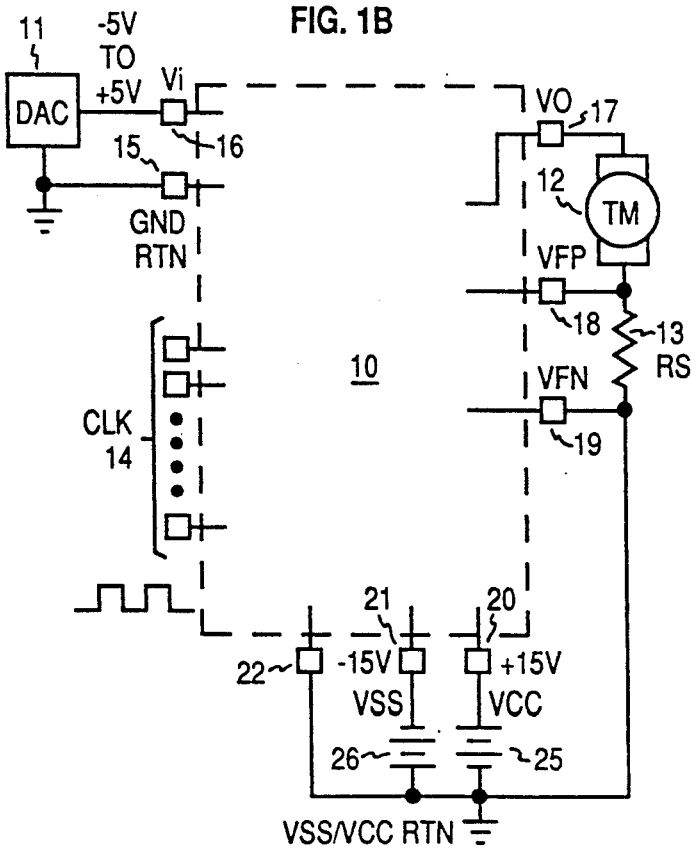

The regulator load circuit consists of the external load current sensing resistor 13 and the torque motor 12. The resistor 13 has one terminal connected to the pads 17 and 18 and the other terminal to the pad 19. The resistor 13 is a precision (0.10%, Lifetime accuracy) resistor having a value $R_s$. The load is connected between the other terminal of resistor 13 and ground return pad 22. This is the "high" sensing configuration shown in FIG. 1A. Alternatively, the torque motor may be connected to the regulator output pad 17 with the current sensing resistor being connected between the torque motor and the ground return pad 22, as illustrated in FIG. 1B, in a "low" sensing configuration.

The regulator output voltage is applied across the current sensing resistor 13 and the load 12 in series constraining all load current to flow through resistor 13, and the voltage drop in the current sensing resistor 13 to accurately represent the load current. The notations $VF_P$ and $VF_N$, denoting feedback voltage positive and negative, indicate the output voltages at the resistor terminals which are fed back to equalize the load current to the desired current.

The difference between the feedback voltages at pads 18 and 19 is derived in a differential network 9 to eliminate the common mode error voltage. A charge sample proportional to the feedback voltage ($V_F$), is supplied to a summer 6 at the input of the integrator 7. A charge sample proportional to the control voltage $V_i$ is subtracted from a charge sample proportional to the feedback voltage in the summer. Successive charge differences are then integrated in a negative sense to provide an output voltage, which when suitably sampled, controls the conductance of the driver 8, to equalize the load current to the desired value set by the control voltage.

The output stage of the regulator, symbolized by the amplifier 8, receives its power directly from the $V_{cc}/V_{ss}$ source connected to the pads 20, 21, and 22. The large load currents are conducted by large internal current runs isolated from the "signal" paths as earlier noted. The control voltage is either positive or negative, and the bias voltages are either positive or negative to provide a bidirectional load current. The current direction determines the direction of the torque exerted by the torque motor.

The regulator electronics are sufficiently compact for integration into a small chip area while maintaining high accuracy (±0.25%) without the need for custom trimming. This is attributable to the use of small charges sampled at fixed intervals rather than a continuous current in the feedback network of the regulator. This choice permits the regulator's accuracy to be determined by three small internal capacitors and a single external resistor (13), earlier mentioned. The sampling is controlled by 10 KHZ clocking pulses. "BiMOS" circuitry is utilized, which combines MOS-FET transistors with bipolar transistors. MOSFET transistors, used in the input stage of the amplifiers, provide high input impedances which prevent significant leakage of charge from the small capacitors used in error formation and integration while bipolar transistors used in the driver output stage have low output impedances allowing large output currents. The resulting design permits the capacitors critical to a precision output current to be small (approximately 10, 40, 260 pf) and readily fabricated in a small area (i.e. 2000 sq. mils (0.0025 sq.in.)). As shown in FIG. 5, the design in compatible with integrating four regulators and the necessary utilities into a single chip with a minimum of external components.

Figure 2:
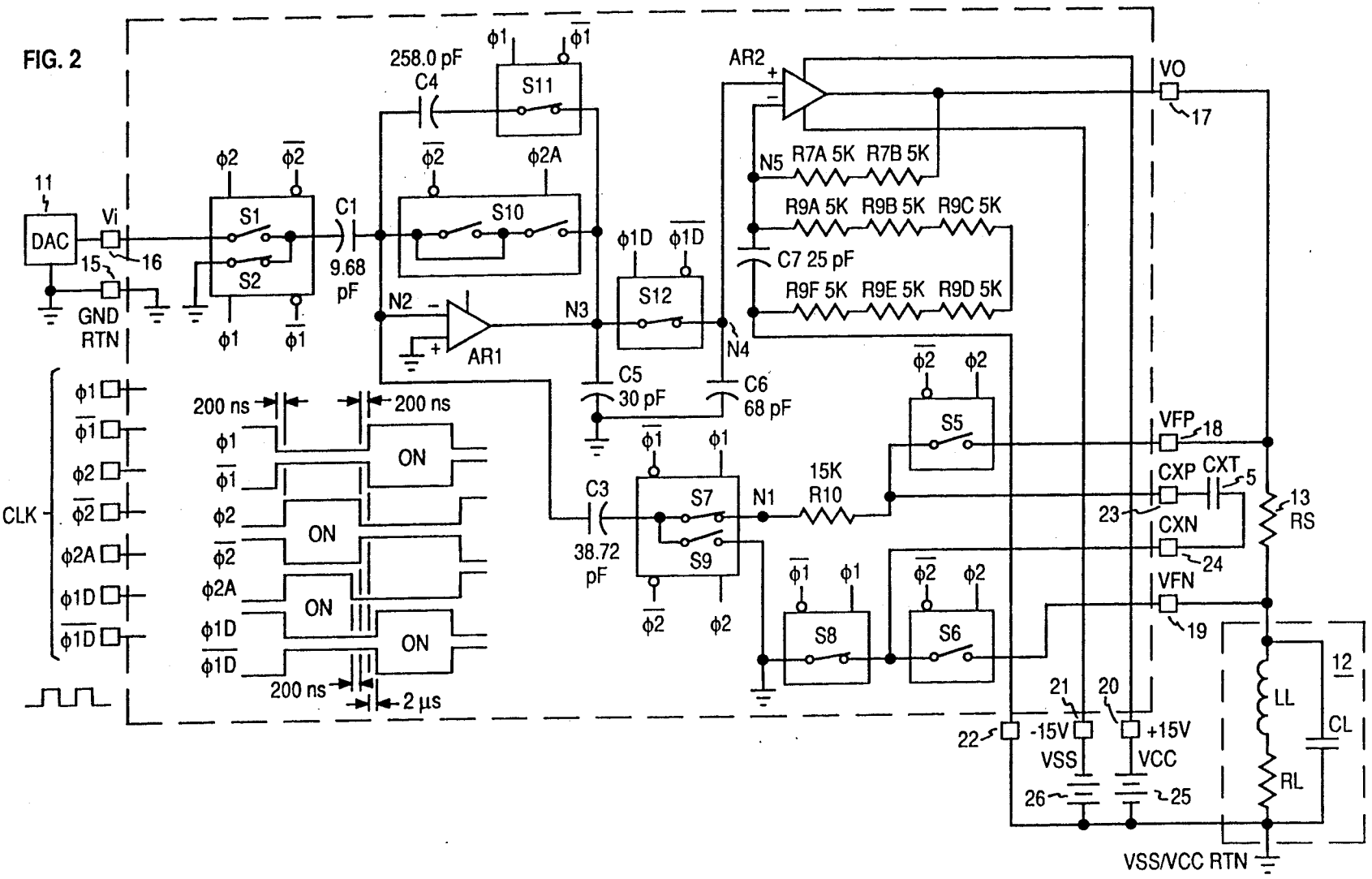
FIG. 2 is a circuit diagram of the current regulator illustrated in FIG. 1 for driving a reversible torque motor and constituted of a plurality of cells formed in an integrated circuit.

Bidirectional regulator current flows are facilitated by transmission gates which use complementary MOSFET transistors, by complementary symmetry in the design of the operational amplifiers, and by taking advantage of clocked operation to effect a polarity reversal in stored charge. The principal internal operations of the regulator, save for the actual supply of current to the load, are clocked by an external clock having a pulse repetition rate of 40 KHZ. The external clock, as shown in FIG. 2, drives local clock generators on the integrated circuit to provide two phase, non-overlapping 10 KHZ clock signals $\phi_1$ and $\phi_2$. These clock signals are advanced 100 nanoseconds for controlling a transmission gate ($S_{10}$) at the integrator, and are delayed 2-3 microseconds in a sample and hold circuit following the integrator.

A more detailed illustration of the current regulator is provided in FIG. 2. FIG. 2 shows the principal external components of and connections to the regulator and the principal cells of the integrated circuit making up the regulator. FIG. 2 shows additional pads 23 and 24, which are provided for connection to a relatively large (0.47 microfarad nominal) external capacitor $C_{ext}$ which stores a sampled charge proportional to the voltage drop across external current sensing resistor 13. Pads 18 and 19 marked $VF_P$ and $VF_N$ are connected across the sensing resistor to derive this voltage drop. The torque motor, which is shown at 12 as an equivalent R, L, C network, is connected between the resistor 13 and the power ground return 22.

The current regulator (10), as shown in FIG. 2, comprises eight cells (indicated by rectangular blocks) each performing a switching function, two cells forming operational amplifiers, and seven capacitors and nine resistors having operational significance.

The first operational amplifier $AR_1$ and its input and output circuits perform the functions symbolized by the summer 6, integrator 7, and differential network 9 of FIG. 1A. It is connected as shown in FIG. 2.

The operational amplifier $AR_1$ has an inverting input, a non-inverting input, and an output. The control voltage $V_i$ represented by a ratioed charge sampled in a negative sense at the clocking rate, and the feedback voltage $V_F$ represented by a ratioed charge sampled in a positive sense at the clocking rate are coupled to the inverting input terminal of $AR_1$, which corresponds to node $N_2$. The non-inverting input terminal of $AR_1$ is connected to signal ground. The output terminal of $AR_1$, which corresponds to node $N_3$, provides the integrator output.

The control voltage $V_i$, sampled in a negative sense and represented by a charge whose ratio to the voltage $V_i$ is set by capacitor $C_1$, is coupled to node $N_2$. The control voltage $V_i$, available at the pad 16, is connected via the clocked transmission gate $S_1$, which is conductive during the phase 2 ($\phi_2$) clocking period, to a first terminal of the desired current ratioing capacitor $C_1$. The second terminal of capacitor $C_1$ is connected to node $N_2$. The first terminal of the capacitor $C_1$ is also connected via the clocked transmission gate $S_2$, which is conductive during the phase 1 ($\phi_1$) clocking period, to signal ground.

The action of transmission gates $S_1$ and $S_2$, since the $\phi_1$ and $\phi_2$ clock signals are timed to prevent both gates from being simultaneously conductive, is that of a single pole double throw switch. Thus the during phase 1 ($\phi_1$) clocking interval, the first terminal of capacitor $C_1$ is connected to signal ground, while during the phase 2 ($\phi_2$) clocking interval, the first terminal of capacitor $C_1$ is connected to the pad 16 for application of the control signal ($V_i$).

Figures 3A, 3D:
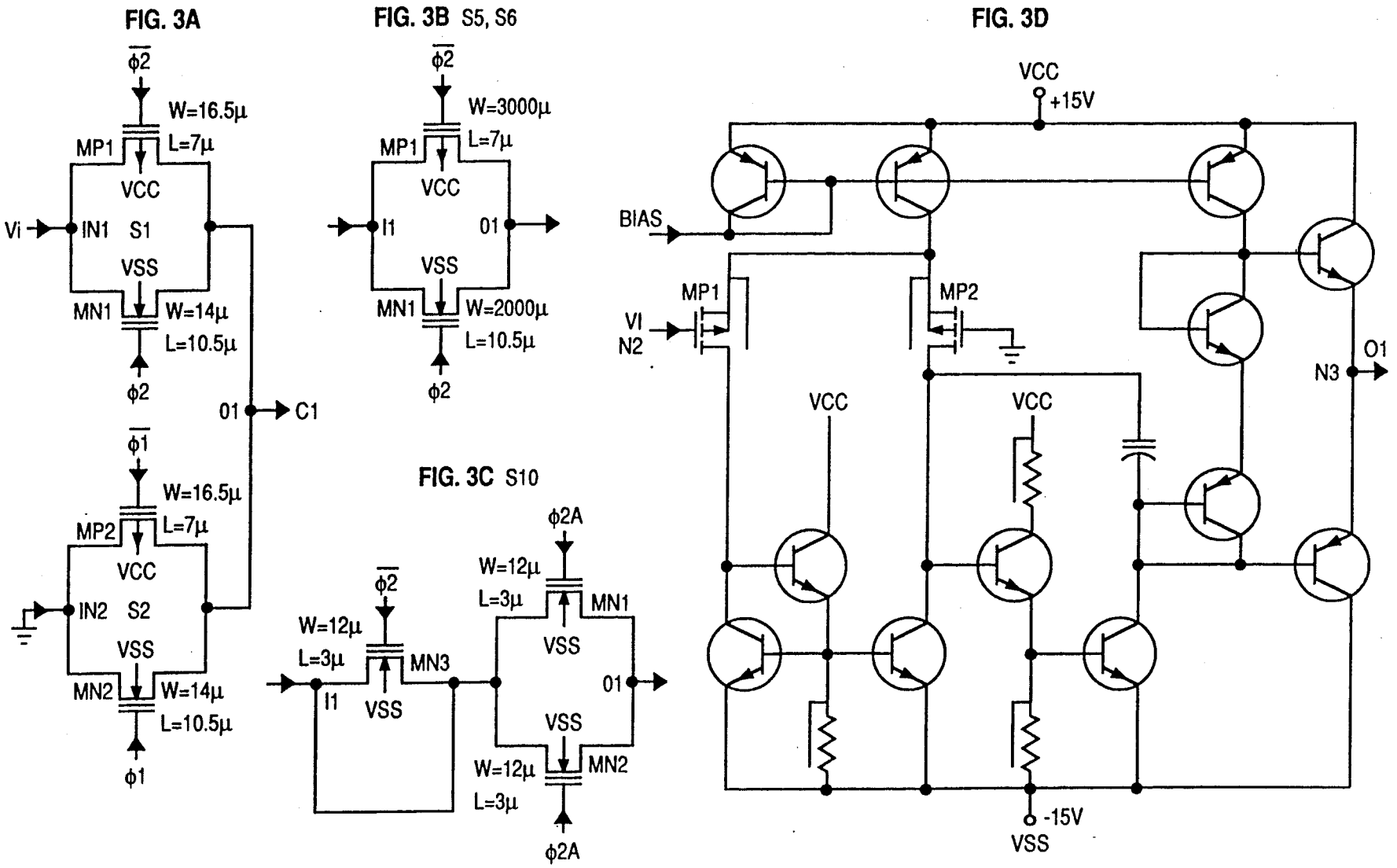

The cell of the integrated circuit which provides single pole double throw action by transmission gates $S_1$ and $S_2$ is illustrated in FIG. 3A. Each gate is formed of two complementary metal oxide semiconductor field effect transistors (MOSFETs) connected in parallel. The gate $S_1$ consists of MOSFET transistors $MN_1$ and $MP_1$ and the gate $S_2$ consists of MOSFET transistors $MN_2$ and $MP_2$.

As illustrated in FIG. 3A, the transmission gates are each operated under control of a clock signal and its complement. The transistor $MN_1$ of transmission gate $S_1$ is an "n" channel device, which has its bulk returned to $V_{ss}$ (−15 volts) to reverse bias the source and drain and to allow conduction only when the gate voltage permits. The other transistor $MP_1$ of gate $S_1$ is a "p" channel device which has its bulk returned to $V_{cc}$ (+15 volts) also to reverse bias the source and drain and to allow conduction only when the gate voltage permits. The inverted phase 2 clock is coupled to the gate of transistor $MP_1$ and the uninverted phase 2 clock is coupled to the gate of transistor $MN_1$. These connections allow gate $S_1$ to be conductive during the phase 2 ($\phi_2$) clocking intervals, i.e. when $\phi_2$ is high and $\phi_2$ is low.

The transistors $MN_2$ and $MP_2$ of gate $S_2$ are biased similarly to the transistors of gate $S_1$, but as noted earlier, are clocked with phase 1 rather than phase 2 clocking signals. The inverted phase 1 clock is connected to the gate of transistor $MP_2$ and the uninverted phase 1 clock is coupled to the gate of transistor $MN_2$. These connections allow gate $S_2$ to be conductive during the phase 1 ($\phi_1$) clocking intervals, i.e. when $\phi_1$ is high and $\phi_1$ is low. As earlier noted, the phase 1/phase 2 clocking intervals are timed to prevent simultaneous conduction by the gates $S_1$ and $S_2$ and to provide alternate conduction. The relevant waveforms are shown in FIG. 2.

Continuing, with the cell shown in FIG. 3A, the two transmission gates $S_1$ and $S_2$ are interconnected at output node $O_1$, while their inputs $IN_1$ and $IN_2$ are separate. The cell input $IN_1$ of gate $S_1$ is connected to the pad 16 for application of $V_i$; the cell input $IN_2$ of gate $S_2$ is connected to signal ground; and the cell output $O_1$ is connected to the first terminal of capacitor $C_1$. The other terminal of $C_1$ is connected to the inverting terminal of OPAMP $AR_1$ at node $N_2$.

A quantity of charge proportional to load current is also coupled to node $N_2$. It is obtained differentially, as implied by block 9 of FIG. 1A, to eliminate the common mode error present at the terminals of the current sensing resistor. The circuit performing this function includes the external current sensing resistor 13, the external capacitor 5, and the integrated transmission gates $S_5$, $S_6$, $S_7$, $S_8$, $S_9$ integrated resistor $R_{10}$, and the integrated load current ratioing capacitor $C_3$.

The foregoing elements provide the differential function for elimination of the common mode error. The load current, which is sensed in the current sensing resistor 13, produces a voltage drop between pads 18 and 19 equal to the product of resistance $R_s$ times the load current. Since the resistance $R_s$ is a fixed, accurately determined quantity, established by choice, the load current becomes known by dividing the measured voltage drop by resistance $R_s$. The voltage at the pad 18 is $VF_P$ and at the pad 19 $VF_N$. The difference in these voltages ($V_F$) is the voltage drop by which the load current measured.

The quantity $V_F$ might well be directly supplied through the load current ratioing capacitor $C_3$ to the input of the differential amplifier. However, the absolute voltages at the terminals 18 and 19 contain a common mode error voltage. It represents a variable IR drop due to significant resistance in the ground return path of the power circuit. It is much larger in the FIG. 1A embodiment where the sensing resistor is high and the torque motor is in the ground return path and smaller in the FIG. 1B embodiment, where the resistance is primarily the resistance in the ground returns.

Accurate operation in the FIG. 1A embodiment and substantial improvement in the accuracy in the FIG. 1B embodiment, are achieved by use of the external capacitor 5 and the transmission gates $S_5$, $S_6$, and $S_8$, which effect a transfer of the voltage drop which rejects the common mode error to the node $N_1$.

As illustrated in FIG. 2, the pad 18, at which the feedback voltage $VF_P$ from the "high" terminal of the current sensing resistor 13 appears, is connected to the $I_1$ terminal of the transmission gate $S_5$. The transmission gates $S_5$ and $S_6$ are shown more exactly in FIG. 3B. They are similar in principle to the transmission gates of FIG. 3A but use devices of much greater gate widths ($MN_1$—2000 microns; $MP_1$—3000 microns) to achieve a low (approximately 20Ω) on resistance. The $O_1$ terminal of transmission gate $S_5$ is connected to the pad 23 to which the "high" terminal of the external capacitor 5 is connected, and via resistor $R_{10}$ to the node $N_1$ leading to the summer input. Similarly, the pad 19 at which the feedback voltage $VF_N$ from the "low" terminal of the current sensing resistor 13 appears, is connected to the $I_1$ terminal of the transmission gate $S_6$. The $O_1$ terminal of gate $S_6$ is connected to the pad 24, to which the "low" terminal of the external capacitor 5 is connected, and to the $I_1$ terminal of the transmission gate $S_8$, whose $O_1$ terminal is connected to signal ground.

The sampling of the voltages $VF_P$ and $VF_N$ to obtain the voltage $V_F$ free of the common mode error at node $N_1$ is achieved by transmission gates $S_5$, $S_6$ and $S_8$ controlled by phase 1 and phase 2 clocking. During the phase 2 clocking intervals, gates $S_5$ and $S_6$ are conductive, and the external capacitor 5, is charged to the voltage drop developed across the current sensing resistor 13. When the phase 2 clocking interval ends, both transmission gates $S_5$ and $S_6$ become non-conductive, disconnecting both terminals of the external capacitor from the sensing resistor. The connection of the high terminal of the external capacitor via the resistance $R_{10}$ to the node $N_1$ leading to the current ratioing capacitor $C_3$, is maintained however, and is not switched. During the phase 1 clocking interval, the gate $S_8$ becomes conductive, connecting the low terminal of capacitor 5 to signal ground. The stored voltage on the capacitor, which has been floating for the brief instant following termination of the $\phi_2$ clocking interval, is now referenced to signal ground and coupled to the node $N_1$ for transfer to the load current ratioing capacitor $C_3$.

The practice of not using $VF_P$ and $VF_N$ individually but using only their difference $V_F$, and of referencing that difference to signal ground in the differential network removes substantially all common mode error from the measured load current. The present circuit provides a greater than 60 dB common mode rejection ratio (CMRR).

The external capacitor (5) is made small enough to charge/discharge with current available from the driver at a rate which can follow the normal rate of change of voltage drops in resistance 13 between successive phase 2 ($\phi_2$) clocking intervals. The external capacitor is made large enough (0.47 microfarads) to store a large charge relative to the charge drawn at node $N_2$ during phase 1 ($\phi_1$) clocking intervals. The load at node $N_2$ includes the current ratioing capacitors $C_1$, $C_3$ and the integrating capacitor $C_4$ of respectively 9.68, 38.72 and 258.0 picofarads. The quantity of charge stored in capacitor 5 at the sensed voltage drop ($V_F$) is so large in relation to that drawn at node $N_2$ during the subsequent phase 1 ($\phi_1$) clocking interval, that the drop in stored voltage from sample to sample, or during any sampling interval, is negligible at the accuracy sought.

Returning to FIG. 2, the feedback voltage ($V_F$) translated via the external capacitor 5 to the node $N_1$, and referenced to signal ground is connected via the phase 1 ($\phi_1$) clocked transmission gate $S_7$ to a first terminal of the load current ratioing capacitor $C_3$, whose second terminal is connected to node $N_2$. The first terminal of the capacitor $C_3$ is also connected via the phase 2 ($\phi_2$) clocked transmission gate $S_9$ to signal ground. The action of the gates $S_7$ and $S_9$, since the phase 1 ($\phi_1$) and phase 2 ($\phi_2$) clocking pulses are timed to prevent both gates from being simultaneously conductive, is that of a single pole double throw switch as in the case of gates $S_1$ and $S_2$ and they may be of the same design.

The subtractive summation of charges proportional to $V_i$ and $V_F$ implied by the element 6 of FIG. 1A and ratioed respectively in proportion to the capacitances of $C_1$ and $C_3$ respectively, occurs in the transfer of charges to node $N_2$. The subtractive summation produces an error charge at node $N_2$, which is integrated in the integrator, corresponding to element 7 in FIG. 1A. In FIG. 2, the OPAMP $AR_1$, the integrating capacitor $C_4$, and the transmission gates $S_{10}$ and $S_{11}$ are used in performing the integration. The integration is in a negative sense, selected to drive the error to zero in a degenerative feedback network. As will be shown, the accuracy of the regulator current setting depends primarily upon the accuracy of the ratio of the capacitance of capacitor $C_3$ to the capacitance of capacitor $C_1$. In the example it is 4 to 1, with an accuracy of ±0.1%.

A charge of a positive polarity proportional to the feedback voltage $V_F$ and proportional to the capacitance of capacitor $C_3$ is coupled during the phase 1 ($\phi_1$) clocking interval for subtractive summation with the charge proportional to $V_1$ at node $N_2$.

During the phase 1 ($\phi_1$) clocking interval, the transmission gates $S_7$ and $S_8$ are conductive. Gate $S_7$ connects the high terminal of the external capacitor 5, storing the feedback voltage, via resistor $R_{10}$ to the first terminal of the current ratioing capacitor $C_3$. Switch $S_7$ connects the low terminal of the external capacitor 5 to signal ground. The second terminal of capacitor $C_3$, is connected to node $N_2$ at the inverting input of the operational amplifier $AR_1$. During phase 1 clocking, the path for charging capacitor $C_3$ to the feedback voltage $V_F$ is completed and a charge proportional to $V_F$ and proportional to the capacitance of $C_3$ is coupled to node $N_2$. When the phase 1 ($\phi_1$) clocking interval ends and the phase 2 ($\phi_2$) clocking interval begins, the gate $S_7$ becomes non-conductive and the gate $S_9$ becomes conductive connecting the first terminal of capacitor $C_3$ to signal ground and allowing it to recharge to the offset voltage of OPAMP $AR_1$ near signal ground.

A charge of negative polarity directly proportional to the control voltage $V_i$, and in proportion to the capacitance of ratioing capacitor $C_1$ is also available for subtractive summation at node $N_2$.

Assuming a positive value for $V_i$, the appearance of an inverted or negative charge on $C_1$ proportional to $-V_i$ is a result of the two phase operation of transmission gates $S_1$ and $S_2$ During the second phase ($\phi_2$) when $S_1$ is conductive, the first terminal of capacitor $C_1$ is charged in a positive sense to $+V_i$ relative to node $N_2$. Voltage follower operation of $AR_1$ during phase 2 ($\phi_2$), allows node $N_2$ to assume the offset voltage and the capacitor $C_1$ to charge to that value. During phase 1 ($\phi_1$) the first terminal of capacitor $C_1$ is connected to signal ground as gate $S_2$ conducts. Thus assuming no flow of charge from capacitor $C_1$ during phase 1 ($\phi_1$), a reduction of $V_i$ (less the offset voltage) would be produced on both plates of capacitor $C_1$, and a voltage of $-V_i$ with respect to the OPAMP offset voltage would appear at node $N_2$. However, since the OPAMP is operating as an integrator during phase 1, charge proportional to $-V_i$ and to the capacitance of $C_1$ is drained from $C_1$ and distributed between $C_3$ and the integrating capacitor $C_4$ at node $N_2$. Circuit node $N_2$ is DC isolated during the phase 1 clocking interval, but the integrating capacitor $C_4$ provides a path for the charge to flow from $C_1$ in an amount equal to ($-V_iC_1$).

Thus during the phase 1 interval both the control voltage $V_i$ represented by a ratioed charge of a negative polarity and the feedback voltage $V_F$ represented by a ratioed charge of positive polarity are available at node $N_2$ for subtractive summation to form an error charge which is integrated during the phase 1 interval.

The integrator 7 of FIG. 1A, which in FIG. 2 comprises the OPAMP $AR_1$, capacitors $C_4$ and $C_5$, and transmission gates $S_{10}$ and $S_{11}$, is controlled to integrate the error charge provided to node $N_2$ in a sampled mode. During phase 2 ($\phi_2$) intervals correction is being made for the normally less than 0.050 millivolts offset error in the OPAMP input. During phase 1 ($\phi_1$) intervals an error charge proportional to the difference between load current and desired current is being integrated on capacitor $C_4$. The integration of the error charge occurs in a negative direction (as implied in FIG. 1A) so as to reduce the error produced during subsequent samples. An error charge is generated at $N_2$, if the ratio of $V_i$ and $V_F$ does not equal the ratio of $C_3$ to $C_1$.

The operational amplifier $AR_1$ which provides the gain stage for the integrator has its inverting input connected to node $N_2$ to which the error charge is applied, and its output, at which the integrator output appears, connected to node $N_3$. The OPAMP $AR_1$, whose circuit diagram is provided in FIG. 3D, combines a high input impedance differential MOSFET input with a complementary bipolar output. The input is of sufficiently high impedance to not drain off significant charge from the small capacitors $C_1$ and $C_3$ providing the error signal between sampling intervals. The integrating capacitor $C_4$ has one terminal connected to node $N_2$ and the other terminal connected via the bidirectional transmission gate $S_{11}$ to node $N_3$.

The bidirectional transmission gate $S_{11}$ is similar in design to gate $S_8$ and is clocked to be conductive to permit integration during phase 1 clocking intervals. The unique BiMOS transmission gate $S_{10}$ is used to facilitate storing the OPAMP offset voltage for cancellation during integration and to provide DC stabilization of the second node ($N_2$). The circuit diagram of the transmission gate $S_{10}$, which is shown in FIG. 3C, has its input $I_1$ connected to node $N_2$, and its output $O_1$ connected to node $N_3$. The gate $S_{10}$ consists of an "n" channel device $MN_3$, with shorted source and drain, clocked by an inverted phase 2 ($\phi_2$) signal, serially connected with two parallel connected "n" channel devices $MN_1$ and $MN_2$ between nodes $N_2$ and nodes $N_3$.

The "n" channel devices $MN_1$ and $MN_2$ are clocked by an advanced phase 2 signal, whose trailing edge is advanced 200 ns ($\phi_{2A}$). The purpose of this advance is to prevent any simultaneous transients on capacitors $C_1$ or $C_3$, when transistor gates $S_1$ amd $S_9$ open, from causing any error charge on $N_2$. This is done in the interest of better offset correction of the integrator output.

The storing of offset error and DC stabilization of node $N_2$ occurs during phase 2 ($\phi_2$) intervals when transmission gate $S_{10}$ is conductive. (Transmission gate $S_{11}$ is not conductive during phase 2 ($\phi_2$) intervals, and prevents integration of charge on capacitor $C_4$.) Conduction by transmission gate $S_{10}$, clocked by the advanced phase 2 signal ($\phi_{2A}$) connecting nodes $N_2$ and $N_3$ together, connects the OPAMP into a voltage follower configuration. This causes the OPAMP output at node $N_3$ to drive node $N_2$ to the OPAMP offset voltage (near signal ground) causing the second terminals of $C_1$ and $C_3$ to be driven to the OPAMP offset voltage. The storing of the offset error and DC stabilization terminates when the advanced phase 2 clocking interval terminates momentarily (approximately 200 nanoseconds) before the beginning of the phase 2 clocking pulse.

Integration of the error charge occurs during the phase 1 ($\phi_1$) clocking interval. The integrator transmission gate $S_{10}$ has been non-conductive for approximately 100 nanoseconds, initiating DC isolation between nodes $N_2$ and $N_3$ when the phase 1 ($\phi_1$) clocking interval begins. During the phase 1 interval, switch $S_{11}$ is conductive, connecting the integrator capacitor $C_4$ to the OPAMP output for error integration. Charges available on ratioing capacitors $C_1$ and $C_3$ are transferred via node $N_2$ for integration on capacitor $C_4$. If the charge transferred to node $N_2$ from capacitor $C_1$ is not cancelled by an equal and opposite charge transferred from capacitor $C_3$, the difference in charge (i.e. error charge) will be integrated by the integrator capacitor $C_4$ causing the output voltage of $AR_1$ at node $N_2$ to change from its previous value.

In addition to the charge from $C_1$ and $C_3$, charge injection from transmission gate $S_{10}$, when it opens, can introduce an error charge on node $N_2$ which will result in a steady-state DC offset error in the closed loop accuracy of the regulator. This charge can be coupled onto the drain and source nodes of a MOSFET during the gate voltage transition via the parasitic gate to drain/source capacitance within the device.

The parasitic charge, which results on $N_2$ due to the gate transition of the "n" channel MOSFETs ($MN_1$, $MN_2$) within transmission gate $S_{10}$, is corrected for by placing a dummy gate $MN_3$ on the $N_2$ side of MOSFETs $MN_1$, $MN_2$, which is clocked by an opposite voltage transition. The dummy transistor $MN_3$ is scaled to compensate for only the gate to source capacitance of the devices $MN_1$ and $MN_2$, assuming that the charge injected is distributed evenly between the drain and source nodes $N_2$ and $N_3$, during opening of the transmission gate $S_{10}$. Capacitor $C_5$ assures this equal charge distribution by providing a charge storage element on $N_3$ equal to the parasitic capacitance on $N_2$, thus equalizing the AC impedance on each side of transmission gate $S_{10}$. Thus if the gate to drain/source capacitance of the dummy transistor is equal to the gate to source capacitance of the switch transistor, the equal and opposite voltage transitions of the respective gates will cause the net charge injected into $N_2$ to be zero, avoiding steady state error in the closed loop accuracy of the regulator.

The integrator output voltage changes with each appearance of an error charge as a function of the values of capacitors $C_1$, $C_3$ and $C_4$. The delta V on $C_1$ is equal to $-V_i$. the delta V on $C_3$ is equal to ($V_F$). Thus if ($-V_iC_1$) is not equal and opposite to ($V_FC_3$) the error charge results, which when integrated causes the output voltage at node $N_3$ to change proportionally. Assuming that all of the charge from capacitor $C_1$ is transferred to capacitor $C_4$, the output of the integrator would change by $-V_i(C_1/C_4)$ volts. However most of capacitor $C_1$'s charge will be absorbed by charge of opposite sign introduced by capacitor $C_3$ which is equal to ($C_3V_F$), causing only the difference in the charge, namely the error charge, to be integrated on capacitor $C_4$. The change in the integrator output (Delta V) is thus equal to:

$$\text{Delta } V=(1/C_4)\,[V_FC_3-V_iC_1].$$

This expression indicates that when an error charge, defined by a non-zero bracketed quantity is present at node 2, a new integrator output voltage, inversely proportional to the capacitance of $C_4$, differing from the prior voltage by Delta V will appear.

The output of integrator 7, returning to the functional diagram of FIG. 1A, is coupled to the input of the driver 8, whose transconductance is varied to control the output current supplied to the regulator load 12, 13. As seen in the circuit diagram of FIG. 2, the integrator output at node 3 is supplied to a sample and hold network gated to take samples during phase 1 ($\phi_1$) intervals (after a short delay). The sample and hold network then supplies an output to the input of the OPAMP $AR_2$ at node $N_4$, fixed from sampling interval to sampling interval. The OPAMP $AR_2$ is the driver for supplying a current to the load 12, 13 precisely controlled by the voltage at node $N_4$.

The sample and hold network comprises a "sampling" capacitor $C_5$ (30 pf) connected between node $N_3$ and signal ground to provide voltage stability during sampling; a bidirectional transmission gate $S_{12}$ connected between nodes $N_3$ and $N_4$; and a "holding" capacitor $C_6$ connected between node $N_4$ and signal ground. The transmission gate $S_{12}$ is similar in design to the transmission gates $S_1$ and $S_2$. Node $N_4$ is connected to the non-inverting input of driver OPAMP $AR_2$.

The taking of a sample occurs when the transmission gate $S_{12}$ becomes conductive. It is clocked by a phase 1 clocking wave form ($\phi_{1D}$) ($\phi_{1D}$) delayed at the leading edge by 2–4 microseconds. The purpose of this delay is to allow for the slew and settling of the integrator output on capacitor $C_4$ prior to coupling the updated voltage sample to the "hold" capacitor $C_6$. This delay allows any transients which might cause an error in the average load current to die out on node $N_3$, before the sample is coupled to the node $N_4$.

Figure 3E:
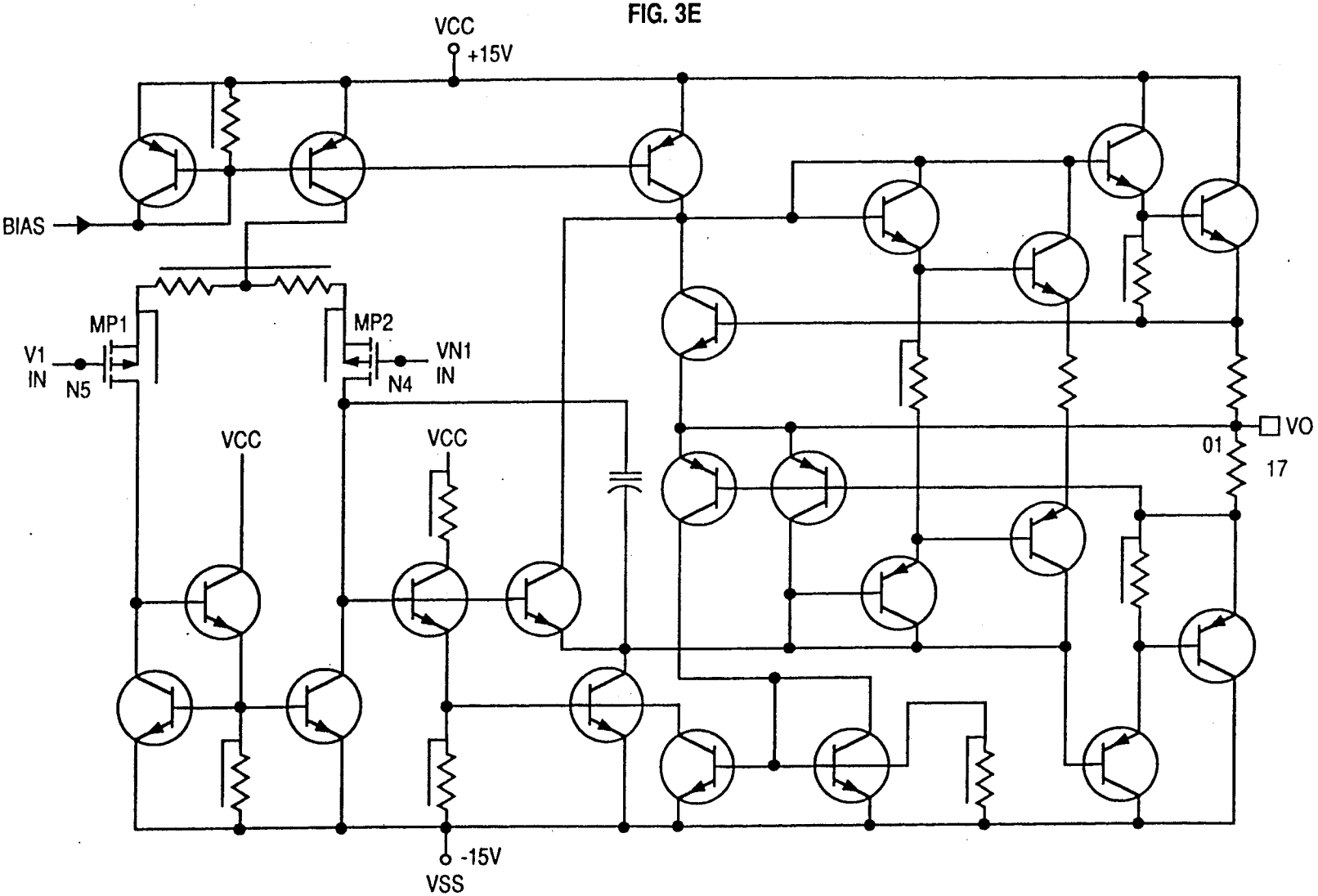

The sampled charge is "held" on capacitor $C_6$ over the period between successive samples. The capacitor $C_6$ may be small (68 pf). since the input impedance of the driver amplifier is high. As shown in FIG. 3E, the input stage of OPAMP $AR_2$ is constituted of a pair of differentially connected MOSFET transistors. Thus, a 68 pf capacitor shunted by the input of the driver OPAMP $AR_2$, accurately sustains the charge, avoiding droop in the voltage from sampling interval to sampling interval.

The other connections to OPAMP $AR_2$ are shown in FIG. 2. The OPAMP output is connected to pad 17 and its inverting input is connected to node 5. The output stages are constituted of low impedance complementary bipolar transistors, which are powered by connections to positive and negative bias sources 25, 26, to provide bidirectional currents to the load.

The closed loop gain of OPAMP $AR_2$ is established (with high frequency roll-off) at 1.33 by a resistive voltage divider connected between the regulator output pad 17, the inverting input at node $N_5$, and power ground at pad 22. The upper branch of the resistive voltage divider comprises two 5000Ω resistance $R_{7A}$ and $R_{7B}$ connected between node $N_5$, and pad 17. The lower branch of the divider comprises six 5000Ω resistors $R_{9A}$–$R_{9B}$ shunted by 25 pf capacitor $C_7$, connected between node $N_5$ and pad 22.

The OPAMP $AR_2$, provides the "driver" for the load. It provides voltage follower action with fixed gain, translating the integrator output voltage transferred from the sample and hold circuit to a load current. Any departure from design values in the gain or offset from those portions of the circuit which follow the summer/integrator, cause negligible error in the output current. This is because in following the summer/integrator, the closed degenerative feedback loop tends to correct for such departures.

The main degenerative current regulating feedback loop is completed when the regulated load current flows through the load current sensing resistor 13, and produces a voltage drop proportional to the current just supplied, reentrant at pads 18 and 19 to form a new feedback voltage ($V_F$). Once the feedback network has converged to produce equality between load current and desired current (and assuming a fixed load), the output current stabilizes. In a practical embodiment, the output current attains equality to the current established by the precise control voltage $V_i$, to within one-quarter of one percent.

The accuracy of current regulation in the novel current regulator herein disclosed, granted a constant clock, depends upon the accuracy achieved in the formation of the three integrated capacitors associated with the integrator; primarily capacitors $C_1$ and $C_3$ having design values of 9.68 pf and 38.72 pf, and secondarily capacitor $C_4$ having a design value of 258.0 pf.

The voltage transfer function of the integrator (alone) may be expressed as follows:

$$V_o=-F_s/SC_4[V_FC_3-V_1C_1]$$

where $V_o$ is the output voltage $F_s$=Sampling frequency ($H_z$)

1/S=S domain representation for an integration $V_F$, $V_i$, $C_4$, $C_3$, $C_1$ are as previously defined.

The accuracy of the transconductance regulator in setting the load current in proportion to the control voltage depends upon the transfer function of the summer/integrator on the integrated circuit, and the external sense resistor 13, which senses the load current, and requires the same level of precision as the elements governing summer/integrator accuracy.

The summing integrator shown in FIG. 2 can be monolithically integrated onto an IC without requiring the critical integrated components (e.g. the capacitors $C_1$, $C_3$, $C_4$) to be trimmed, while achieving a better accuracy with lesser chip areas than prior continuous regulators using integrated resistors.

In the practical embodiment herein disclosed, the capacitors are polysilicon capacitors fabricated by a conventional precision photolithographic process. The silicon wafer has a first field oxide coating which acts to insulate the capacitor from the substrate; and a first polysilicon capacitor plate formed thereon. Next, following application of a dielectric layer, a second polysilicon capacitor plate is formed. The overall dimensions of the layout are 1400 microns × 1050 microns. The absolute accuracy of the capacitors may vary substantially, as for instance due to variation in the thickness of the dielectric layer, but the capacitance ratios critical to regulator accuracy must be accurately maintained.

Figure 4:
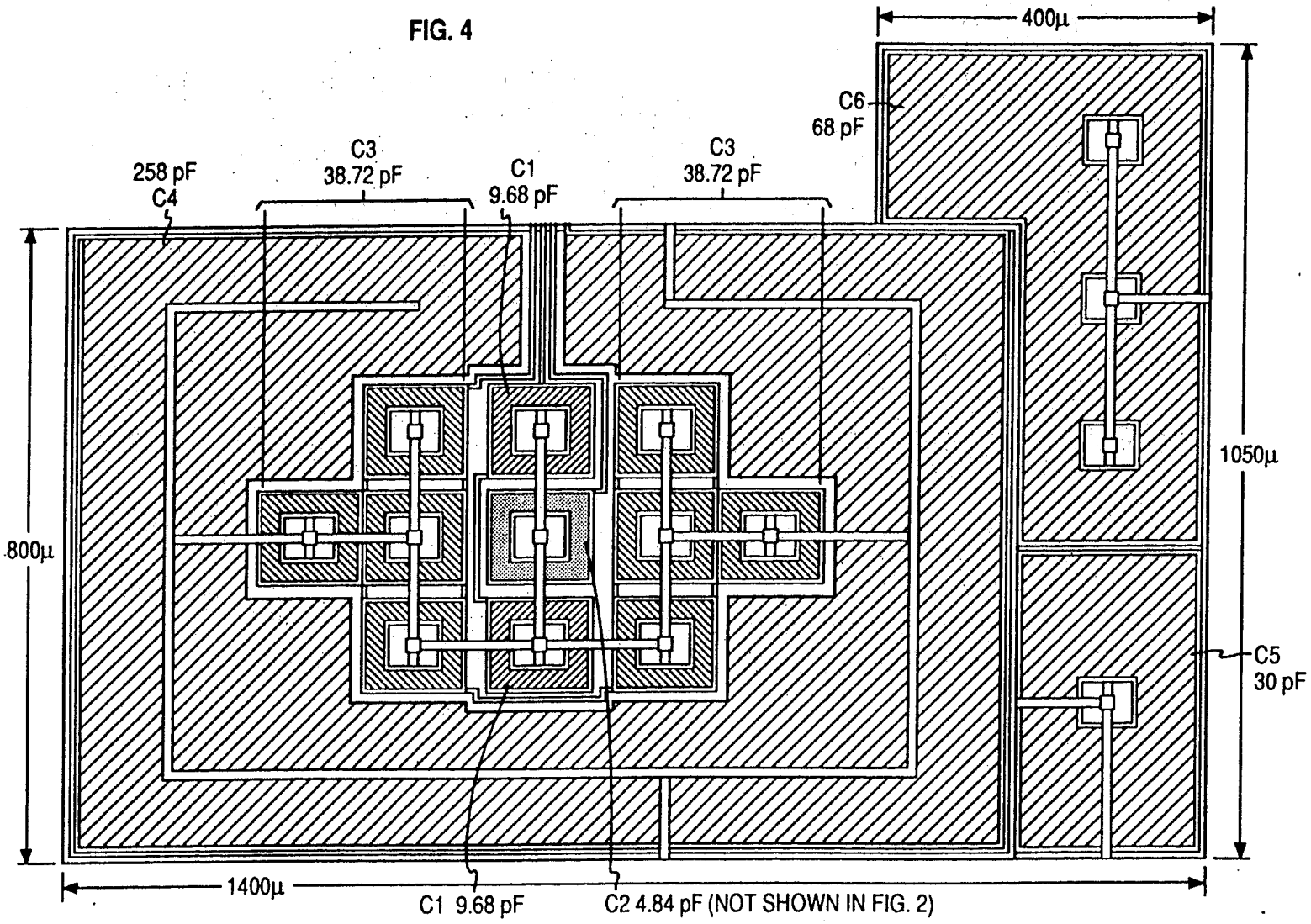
FIG. 4 is a layout of the integrated capacitors, which establish a precise relationship between the load current and a precision control voltage and which permit such precision in a compact monolithic integrated circuit layout.

The capacitors $C_4$, $C_3$ and $C_1$ (including a third smaller capacitor $C_2$ not used in the FIG. 2 circuit diagram), and capacitors $C_5$ and $C_6$ are laid out in the manner shown in FIG. 4.

The regulator accuracy is attributable to the layout of the critical capacitors about a common area centroid, as shown in FIG. 4. This layout maintains the critical ratios in the face of processing variations or thermal gradients which are linear about the locality of the capacitor array. In the illustrated layout, capacitor $C_1$, for instance, is divided into two halves of equal area spaced equidistant from the common center and arranged opposite each other about that center. In the case of $C_1$, one half area is arranged below the center and the other half is arranged above the center.

Similarly capacitor $C_3$ is divided into two parts of equal area symmetrically placed with respect to the same center. Capacitor $C_3$ is formed of four smaller parts of equal area arranged to the left of the center and "balanced" by four parts of equal area symmetrically arranged at equal distances to the left of the same center. Similarly, $C_4$ while not formed in two separate parts, has the area thereof substantially symmetrically arranged about the same center so as to share the same area centroid.

The effect of arranging these capacitors upon a common centroid is to average out the effect of any linear gradient which may exist across the capacitor structure and which would affect the capacitance per unit area. A frequent cause of such a linear gradient arises in manufacturing when deposition of the dielectric constant varies linearly from side to side across the chip. In such a case, one capacitor half will be proportionately larger while the other capacitor half will be proportionately smaller. The two halves of $C_1$ will tend to a common average, and the two halves of $C_3$ will tend to a common average, based on the average thickness of dielectric (for example) at the common center. The practice tends to preserve the accuracy of the critical $C_1$ to $C_3$ ratio, and also the accuracy of the somewhat less critical ratio of $C_1$ to $C_4$, and $C_3$ to $C_4$.

A second potential cause of capacitor variation arises in operation when heat is being produced at the corners of the chip containing the regulator by power stages which create linear thermal gradients across the regulator's critical capacitors. While the model is not completely analyzed, a first order effect from these thermal gradients is a change in the apparent dielectric constant across the capacitor layout. Using a common area centroid for the critical capacitors reduces sensitivity of the output current to such local sources of heat.

Assuming that circuit costs, complexity and performance demand an integrated circuit design with minimum outboarded components, the present sampled arrangement provides distinct advantages over prior continuous designs.

The present design provides a 3 to 1 reduction in chip area over prior continuous designs. In a practical case, four "single channel drivers", each of which embody the present regulator, may be integrated on a single chip as shown in FIG. 5.

The present arrangement has a distinct advantage over continuous designs in achieving accuracy. The continuous design requires a large integrating capacitor, which must be outboarded. External capacitors of the required size have poor absolute tolerances, and as a result, their use causes the integrator gain to vary accordingly, causing variations in the AC response of the regulator. In the present design, the integrating capacitor ($C_4$) is small and readily integrated with accuracy, and while a large outboarded capacitor (5) is required for another purpose, its accuracy does not impair the performance of the regulator.

The continuous design requires at least two precision resistors, which if integrated and untrimmed provide a less than satisfactory ±1.0% accuracy. While trimming improves the accuracy, excessive chip area is required and some accuracy is lost over life due to the drift of on-chip resistances due to aging. In contrast, the present small on-chip capacitors of the present sampled design provide an accuracy that is not only greater than that of untrimmed on-chip resistors by a factor of 4, but that accuracy does not diminish comparably with aging due to the good stability of the $S_iO_2$ dielectric.

The present sampled design provides a very effective (>60 dB) and a very simple, passive technique for rejecting common mode voltage (capacitor 5 and associated switches $S_5$–$S_9$). In the continuous implementation, an active differential amplifier is required including an OPAMP and four precision resistors, each requiring trimming.

The present sampled design is more readily corrected for amplifier offset error than the continuous design. In the conventional continuous design, offset corrections are relatively complex. In the present sampled arrangement, the correction is readily accomplished by obtaining the offset error between integrations, and storing it for removal from the error charge prior to integration.

The open loop gain of the integrator may be readily and accurately programmed. This allows for tailoring of the closed loop bandwidth of the regulator for a given load by simply varying the clock frequency. Accurate programmability of the regulator bandwidth is important for insuring stability when driving a reactive load and for optimizing the regulator step response.

It is necessary to passively invert the input control signal $V_i$ rather than the feedback voltage $V_F$ in order to achieve an overall non-inversion between the control signal $V_i$ and the load current and still close the main feedback loop degeneratively. The subsequent inversion in the integrator and the non-inversion of the driver sample and hold stage thus results in a net non-inversion between the control signal $V_i$ and the driver output which provides the load current. If the driver sample and hold stage of the regulator were designed to be inverting, then the inversion states of the control and feedback voltages would be reversed. However, in that case an inverting sample/hold driver would be more complex, requiring an additional amplifier stage. The illustrated inversion states for the input and feedback signals results in the desired regulator performance with minimal design complexity.

What is claimed is:

1. A transconductance current regulator using precisely sampled charges for current control comprising A) means for connecting said regulator to a source of operating potentials, to a load, to a source of control potentials ($V_i$) referenced to ground for establishing a desired load current, and to a clock providing first and second alternate clocking intervals, B) means to obtain a voltage ($V_F$) proportional to load current free of common mode voltage for subsequent charge sampling including (1) a precision resistor serially connected with said load to produce a voltage drop proportional to load current, (2) a capacitor for storing a voltage equal to said voltage drop and for sustaining said stored voltage drop when charge is being sampled, and (3) first clocked switching means for connecting said capacitor to said resistor for charging during said second clocking interval and disconnecting said capacitor from said resistor and applying said stored voltage to a first node referenced to ground for sampling during said first clocking interval, C) first clocked switching/capacitive means having a capacitance ($C_i$) for charging to said control potential and during said first clocking interval discharging into a second node to transfer a sample charge precisely ratioed to said control potential, D) second clocked switching/capacitive means having a capacitance ($C_F$) which is small in relation to that of said storage capacitor connected to said first node for charging to said voltage drop, and during said first clocking interval discharging into said second node to transfer a sample charge precisely ratioed to said voltage drop, E) means for obtaining an error charge representing the difference between said ratioed charge samples at said second node during said first clocking interval, F) a negative feedback loop for bringing said load current into equality with said desired current comprising (1) a clocked integrator including a second capacitor for integrating the error charge at said second node to provide an output voltage at a third node during said first clocking interval, and (2) a driver stage connected between said source of operating potentials and said series connected precision resistor and load, whose conductance responds to the voltage at said third node in a sense to bring said error charge to zero and equalize the product of said control voltage ($V_i$) and the capacitance ($C_i$) of said first switching/capacitive means with the product of said voltage drop ($V_F$) and the capacitance ($C_F$) of said second switching/capacitive means:

$$(V_F C_F = V_i C_i)$$

2. The current regulator set forth in claim 1, wherein said clocked integrator further comprises (1) an operational amplifier (OPAMP) having its input connected to said second node and its output connected to said third node, and (2) a second clocked switching means is serially connected with said integrating capacitor between said second and third nodes, clocked to permit integration of error charge during said first clocking interval.

3. The current regulator set forth in claim 2, wherein said clocked integrator further comprises third clocked switching means connected between said second and third node, clocked to conduct during said second clocking interval to effect voltage follower operation of said OPAMP for DC stabilization of said second node and for storage of the OPAMP offset voltage on said second node to prevent integration of said offset voltage during integration of said error charge.

4. The current regulator set forth in claim 3, wherein said OPAMP has a high input impedance providing negligible leakage of charge from said second node between clocking intervals and permitting said capacitances $C_i$ and $C_F$ to be small.

5. The current regulator set forth in claim 4, having in addition clocked sample and hold means connected between said third node and the input to said driver stage at a fourth node, and comprising fourth switching means and a second capacitor for storing the integrator output between clocking intervals connected between said fourth node and ground, and wherein said driver stage comprises an OPAMP having a high input impedance at said fourth node providing negligible leakage of charge between clocking intervals and permitting said second capacitor to be small.

6. The current regulator set forth in claim 5, wherein said operating potentials for said regulator are both positive and negative to provide bidirectional currents, said first, second and third clocked switching means, and said first and second clocked switching/capacitive means utilize transmission gates, each formed of complementary metal oxide semiconductor field effect transistors (MOSFETs) for conducting bidirectional currents, and wherein said first and second OPAMPS each include differential MOSFET input stages, and complementary output stages.

7. The current regulator set forth in claim 1, wherein the principal components thereof excluding said precision resistor and said storage capacitor are monolithically integrated onto a semiconductor chip using a bipolar/MOSFET process, and wherein the output stages of said operational amplifiers utilize complementary bipolar transistors to achieve low output impedances in bidirectional operation.

8. The current regulator set forth in claim 7, wherein said first switching/capacitive means is integrated with the areas of the capacitor thereof being arranged symmetrically about a first area centroid, and said second switching/capacitive means is integrated with the areas of the capacitor thereof being arranged symmetrically about the same area centroid to reduce the sensitivity of the ratio of said two capacitors to linear errors in the capacitance per unit area.

9. The current regulator set forth in claim 7, wherein (1) the capacitance ($C_i$) of said first clocked switching/capacitive means is provided by a third capacitor having one terminal connected to said second node, and wherein said first clocked switching/capacitive means further comprises (2) a fifth clocked switching means having single pole double throw action for alternately connecting the other terminal of said third capacitor to the source of control potentials ($V_i$) during said second clocking interval to store sample charges proportional to said control voltage and during said first clocking interval connecting said other capacitor terminal to signal ground to discharge said sample charge into said second node in a polarity opposite to said control voltage.

10. The current regulator set forth in claim 9, wherein (1) the capacitance ($C_F$) of said second clocked switching/capacitive means is provided by a fourth capacitor having one terminal connected to said second node, and wherein said second clocked switching/capacitive means further comprises (2) a sixth clocked switching means having single pole double throw action for alternately connecting the other terminal of said fourth capacitor to said first node during said first clocking interval to transfer sample charges to said second node ($N_2$) in an opposite polarity to said first sample charges to form error charges at said second node, and during said second clocking interval, connecting the other capacitor terminal to signal ground to discharge said fourth capacitor.

* * * * *